US006679581B2

(12) United States Patent
Horvath et al.

(10) Patent No.: US 6,679,581 B2
(45) Date of Patent: Jan. 20, 2004

(54) SURFACE DEFORMATION OF CARRIER FOR PRINTHEAD DIES

(75) Inventors: Janis Horvath, San Diego, CA (US); Lawrence E Gibson, San Diego, CA (US); Byron K Davis, San Diego, CA (US); David K Mc Elfresh, San Diego, CA (US); Gerald V Rapp, Escondido, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 118 days.

(21) Appl. No.: 10/046,459

(22) Filed: Oct. 25, 2001

(65) Prior Publication Data

US 2003/0081059 A1 May 1, 2003

(51) Int. Cl.[7] ..... B41J 2/145; B41J 2/15
(52) U.S. Cl. ..... 347/40
(58) Field of Search ..... 347/40–44, 20, 347/47, 56–74, 1, 5, 6

(56) References Cited

U.S. PATENT DOCUMENTS 4,463,359 A 7/1984 Ayata et al.
5,016,023 A 5/1991 Chan et al.
5,079,189 A 1/1992 Drake et al.
5,098,503 A 3/1992 Drake
5,160,945 A 11/1992 Drake
5,469,199 A 11/1995 Allen et al.
5,696,544 A 12/1997 Komuro
5,719,605 A 2/1998 Anderson et al.
5,742,305 A 4/1998 Hackleman
5,755,024 A 5/1998 Drake et al.
5,946,012 A 8/1999 Courian et al.
6,371,598 B1 * 4/2002 Fujii et al.

OTHER PUBLICATIONS

Allen, R., "Ink Jet Printing with Large Pagewide Arrays: Issues and Challenges", Recent Progress in Ink Jet Technologies II, pp. 114–120.

* cited by examiner

*Primary Examiner*—Raquel Yvette Gordon

(57) ABSTRACT

A printhead assembly includes a carrier including a substrate and a substructure joined to a first surface of the substrate, and a plurality of printhead dies each mounted on a second surface of the substrate. The first surface of the substrate includes a surface deformation and the substructure is joined to the first surface by an adhesive. As such, the adhesive conforms to the surface deformation.

38 Claims, 7 Drawing Sheets

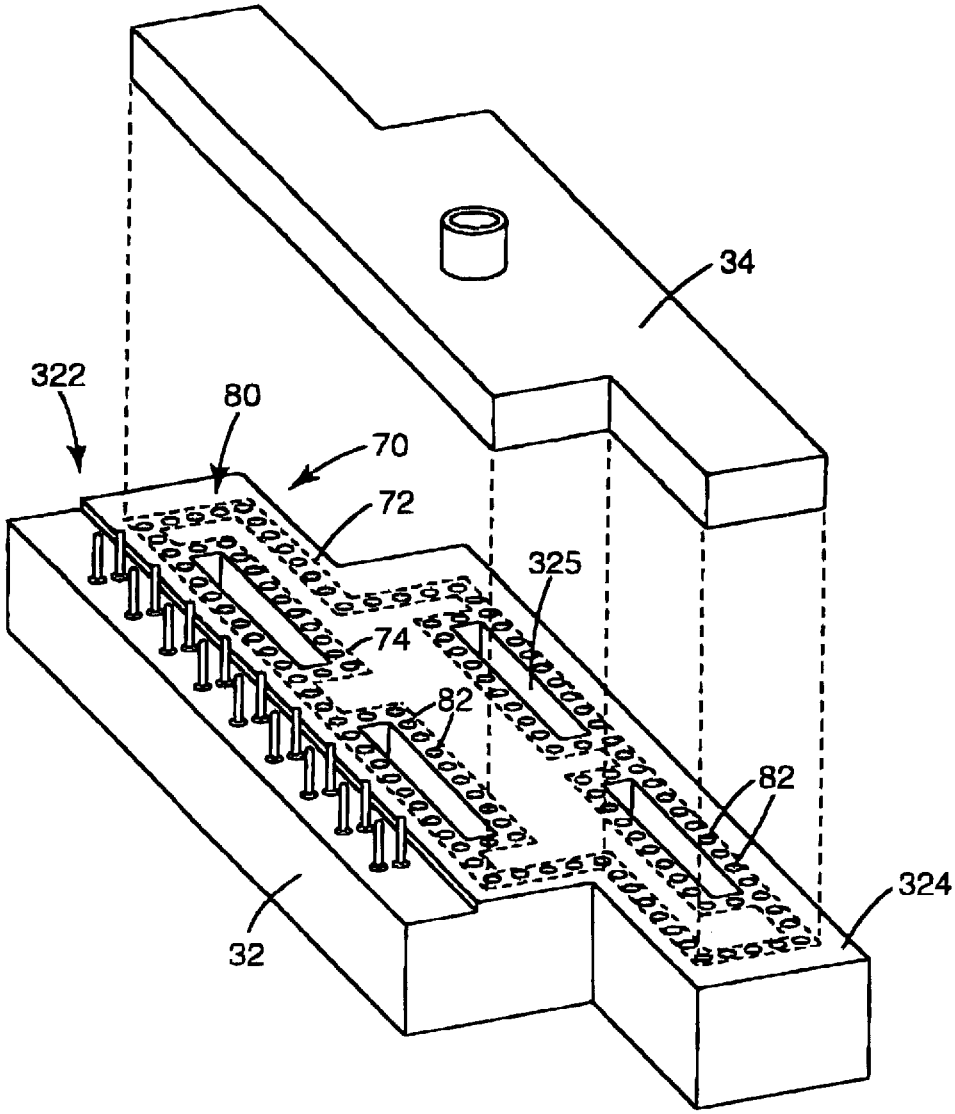
Fig. 7
Fig. 8
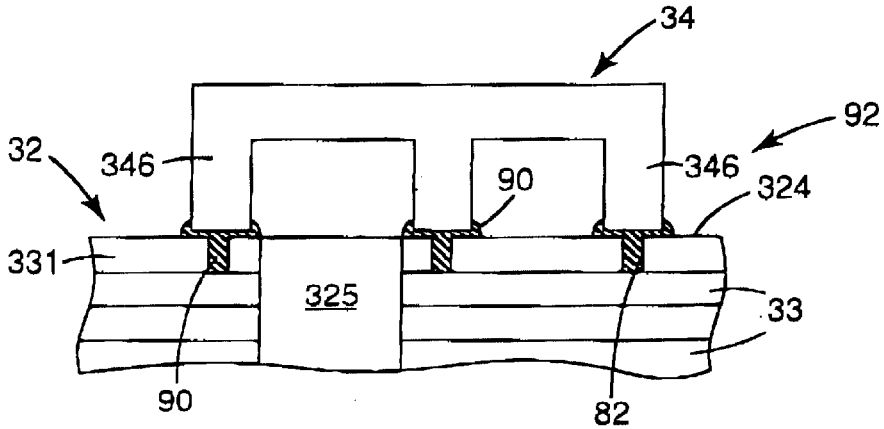

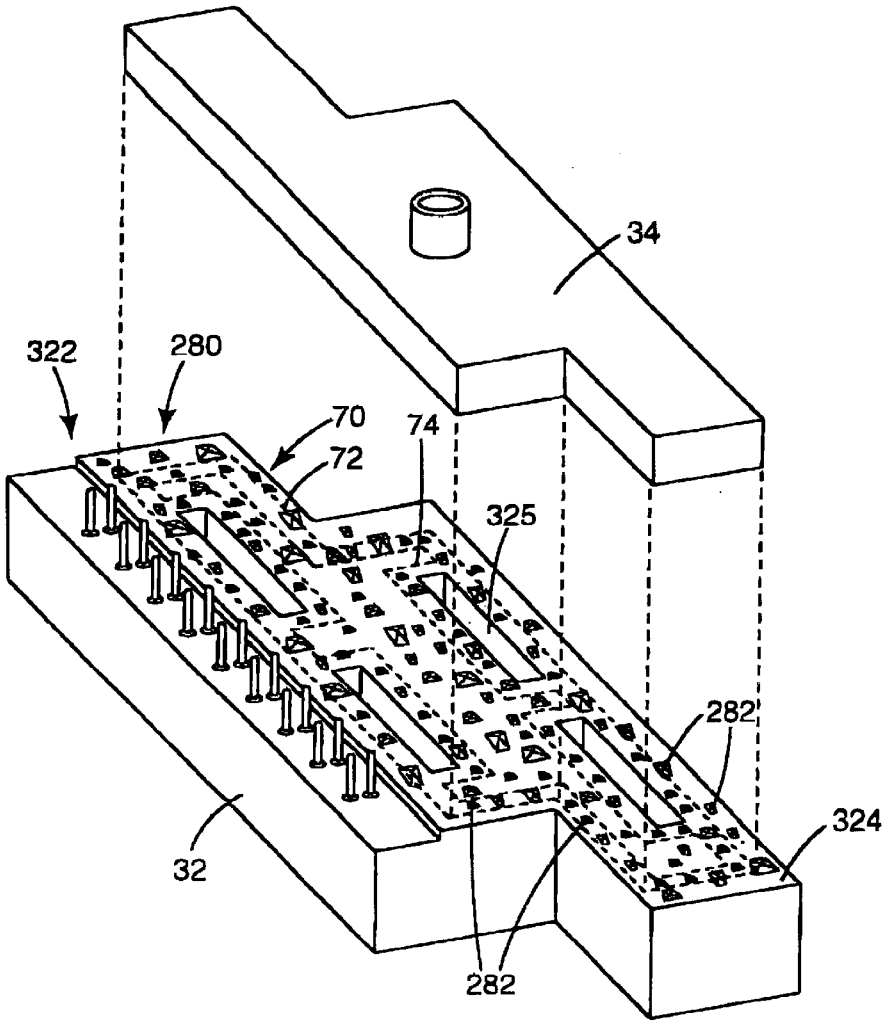
Fig. 11
Fig. 12
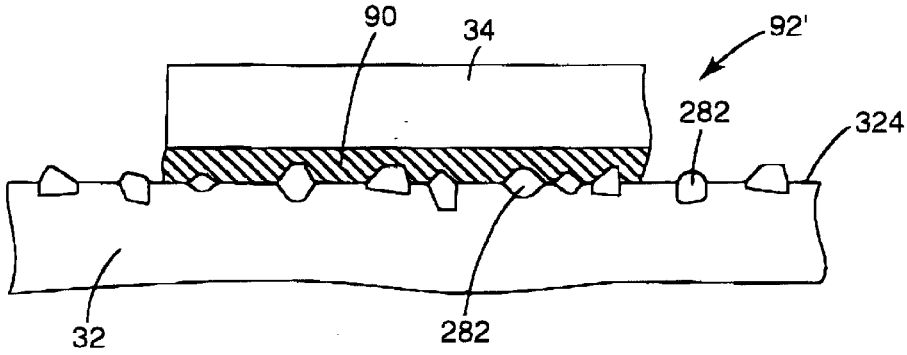

SURFACE DEFORMATION OF CARRIER FOR PRINTHEAD DIES

THE FIELD OF THE INVENTION

The present invention relates generally to inkjet printheads, and more particularly to surface deformation of a carrier for printhead dies.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

In one arrangement, commonly referred to as a wide-array inkjet printing system, a plurality of individual printheads, also referred to as printhead dies, are mounted on a single carrier. As such, a number of nozzles and, therefore, an overall number of ink drops which can be ejected per second is increased. Since the overall number of drops which can be ejected per second is increased, printing speed can be increased with the wide-array inkjet printing system.

Mounting a plurality of printhead dies on a single carrier, however, requires that the single carrier perform several functions including fluid and electrical routing as well as printhead die support. More specifically, the single carrier must accommodate communication of ink between the ink supply and each of the printhead dies, accommodate communication of electrical signals between the electronic controller and each of the printhead dies, and provide a stable support for each of the printhead dies. Unfortunately, effectively combining these functions in one unitary structure is difficult.

To effectively combine the functions of fluid and electrical routing and printhead die support, the single carrier may include multiple components each formed of different materials and joined or assembled together to create the single carrier. As such, the various components may have different coefficients of thermal expansion. Thus, joints between the various components must withstand high temperatures and/or temperature variations during operation of the printing system as well as stresses such as shear, compressive, normal, and/or peeling stresses between the components. In addition, the joints must also be fluid and gas tight to accommodate fluid routing through the carrier.

SUMMARY OF THE INVENTION

One aspect of the present invention provides a printhead assembly. The printhead assembly includes a carrier including a substrate and a substructure joined to a first surface of the substrate, and a plurality of printhead dies each mounted on a second surface of the substrate. The first surface of the substrate includes a surface deformation and the substructure is joined to the first surface by an adhesive. As such, the adhesive conforms to the surface deformation.

BRIEF DESCRIPTION OF THE DRAWINGS

FIG. 7 is an exploded bottom perspective view of the inkjet printhead assembly of FIG. 2 illustrating one embodiment of a surface deformation of a substrate and joining of a substructure to the substrate according to the present invention.

FIG. 8 is a schematic cross-sectional view illustrating one embodiment of joining the substructure to the substrate of FIG. 7 according to the present invention.

FIG. 11 is an exploded bottom perspective view similar to FIG. 7 illustrating another embodiment of a surface deformation of a substrate and joining of a substructure to the substrate according to the present invention.

FIG. 12 is a schematic cross-sectional view illustrating one embodiment of joining the substructure to the substrate of FIG. 11 according to the present invention.

DESCRIPTION OF THE PREFERRED EMBODIMENTS

In the following detailed description of the preferred embodiments, reference is made to the accompanying drawings which form a part hereof, and in which is shown by way of illustration specific embodiments in which the invention may be practiced. In this regard, directional terminology, such as top, "bottom," "front," "back," "leading," "trailing," etc., is used with reference to the orientation of the Figure(s) being described. The inkjet printhead assembly and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
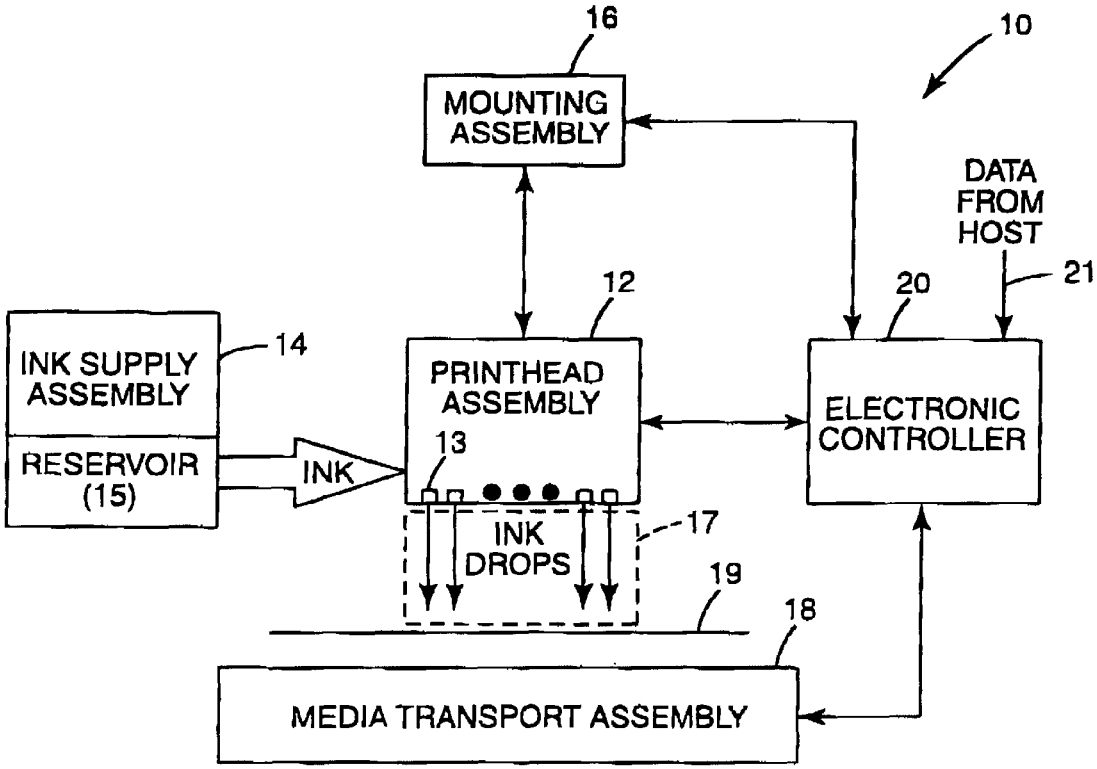
FIG. 1 is a block diagram illustrating one embodiment of an inkjet printing system according to the present invention.

FIG. 1 illustrates one embodiment of a printing system 10 according to the present invention. Printing system 10 includes an inkjet printhead assembly (or fluid ejection assembly) 12, a fluid (or ink) supply assembly 14, a mounting assembly 16, a media transport assembly 18, and an electronic controller 20. Inkjet printhead assembly 12 is formed according to an embodiment of the present invention, and includes one or more printheads which eject drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is retuned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller 20 communicates with inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system IO and includes one or more print job commands and/or command parameters.

In one embodiment, electronic controller 20 provides control of inkjet printhead assembly 12 including timing control for ejection of ink drops from nozzles 13. As such, electronic controller 20 defines a pattern of ejected ink drops which form characters, symbols, and/or other graphics or images on print medium 19. Timing control and, therefore, the pattern of ejected ink drops, is determined by the print job commands and/or command parameters. In one embodiment, logic and drive circuitry forming a portion of electronic controller 20 is located on inkjet printhead assembly 12. In another embodiment, logic and drive circuitry is located off inkjet printhead assembly 12.

Figure 2:
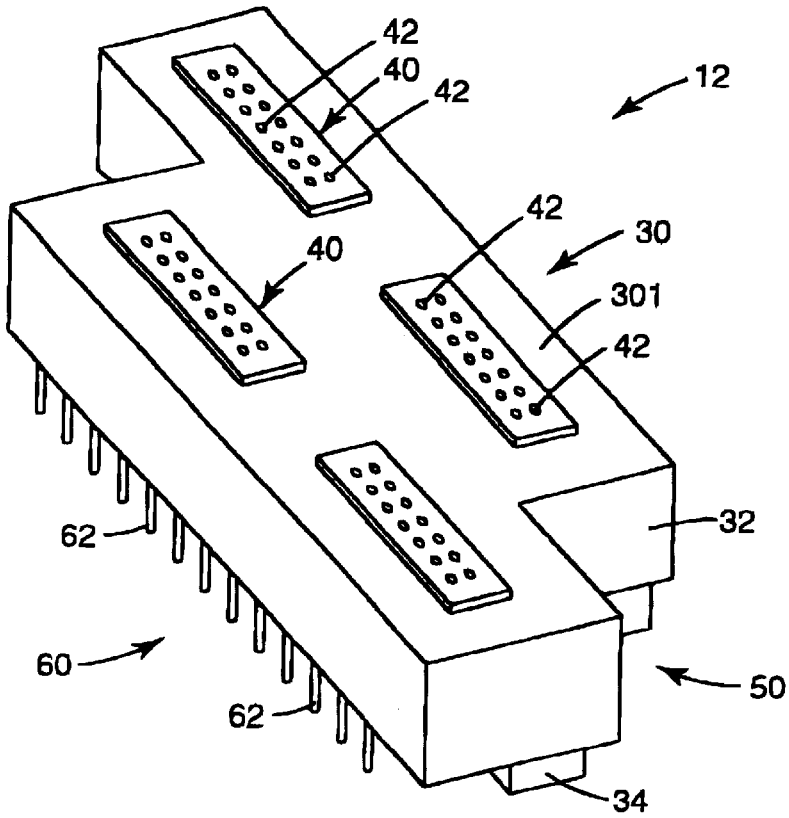
FIG. 2 is a top perspective view of a printhead assembly according to an embodiment of the present invention.
Figure 3:
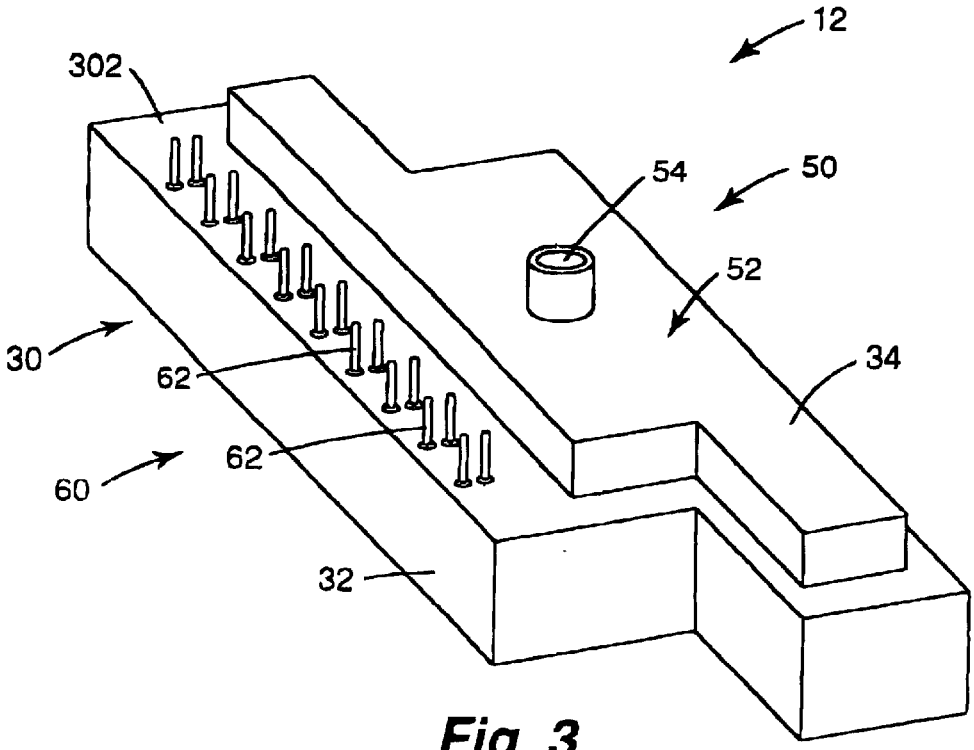
FIG. 3 is a bottom perspective view of the inkjet printhead assembly of FIG. 2.

FIGS. 2 and 3 illustrate one embodiment of a portion of inkjet printhead assembly 12. Inkjet printhead assembly 12 is a wide-array or multi-head printhead assembly and includes a carrier 30, a plurality of printhead dies 40, an ink delivery system 50, and an electronic interface system 60. Carrier 30 has an exposed surface or first face 301 and an exposed surface or second face 302 which is opposite of and oriented substantially parallel with first face 301. Carrier 30 serves to carry or provide mechanical support for printhead dies 40. In addition, carrier 30 accommodates fluidic communication between printhead dies 40 and ink supply assembly 14 via ink delivery system 50 and accommodates electrical communication between printhead dies 40 and electronic controller 20 via electronic interface system 60.

Printhead dies 40 are mounted on first face 301 of carrier 30 and aligned in one or more rows. In one embodiment, printhead dies 40 are spaced apart and staggered such that printhead dies 40 in one row overlap at least one printhead die 40 in another row. Thus, inkjet printhead assembly 12 may span a nominal page width or a width shorter or longer than nominal page width. In one embodiment, a plurality of inkjet printhead assemblies 12 are mounted in an end-to-end manner. Carrier 30, therefore, has a staggered or stair-step profile. Thus, at least one printhead die 40 of one inkjet printhead assembly 12 overlaps at least one printhead die 40 of an adjacent inkjet printhead assembly 12. While four printhead dies 40 are illustrated as being mounted on carrier 30, the number of printhead dies 40 mounted on carrier 30 may vary.

Ink delivery system 50 fluidically couples ink supply assembly 14 with printhead dies 40. In one embodiment, ink delivery system 50 includes a manifold 52 and a port 54. Manifold 52 is formed in carrier 30 and distributes ink through carrier 30 to each printhead die 40. Port 54 communicates with manifold 52 and provides an inlet for ink supplied by ink supply assembly 14.

Electronic interface system 60 electrically couples electronic controller 20 with printhead dies 40. In one embodiment, electronic interface system 60 includes a plurality of electrical contacts 62 which form input/output (I/O) contacts for electronic interface system 60. As such, electrical contacts 62 provide points for communicating electrical signals between electronic controller 20 and inkjet printhead assembly 12. Examples of electrical contacts 62 include I/O pins which engage corresponding I/O receptacles electrically coupled to electronic controller 20 and I/O contact pads or fingers which mechanically or inductively contact corresponding electrical nodes electrically coupled to electronic controller 20. Although electrical contacts 62 are illustrated as being provided on second face 302 of carrier 30, it is within the scope of the present invention for electrical contacts 62 to be provided on other sides of carrier 30.

Figure 4:
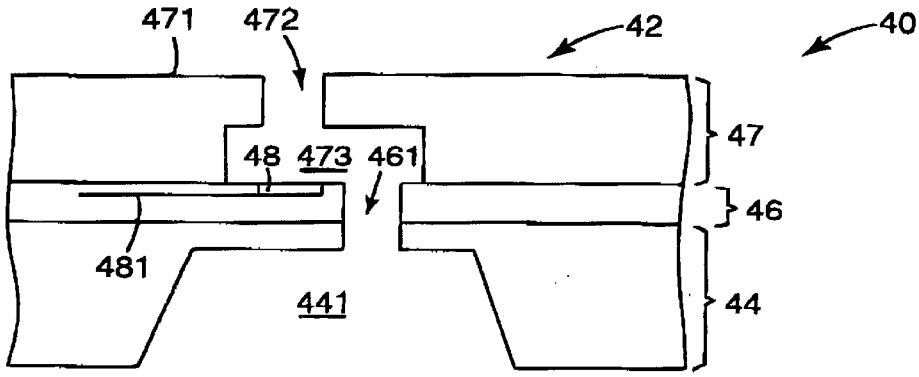
FIG. 4 is a schematic cross-sectional view illustrating portions of a printhead die according to one embodiment of the present invention.

As illustrated in FIGS. 2 and 4, each printhead die 40 includes an array of printing or drop ejecting elements 42. Printing elements 42 are formed on a substrate 44 which has an ink feed slot 441 formed therein. As such, ink feed slot 441 provides a supply of liquid ink to printing elements 42. Each printing element 42 includes a thin-film structure 46, an orifice layer 47, and a firing resistor 48. Thin-film structure 46 has an ink feed channel 461 formed therein which communicates with ink feed slot 441 of substrate 44. Orifice layer 47 has a front face 471 and a nozzle opening 472 formed in front face 471. Orifice layer 47 also has a nozzle chamber 473 formed therein which communicates with nozzle opening 472 and ink feed channel 461 of thin-film structure 46. Firing resistor 48 is positioned within nozzle chamber 473 and includes leads 481 which electrically couple firing resistor 48 to a drive signal and ground.

During printing, ink flows from ink feed slot 441 to nozzle chamber 473 via ink feed channel 461. Nozzle opening 472 is operatively associated with firing resistor 48 such that droplets of ink within nozzle chamber 473 are ejected through nozzle opening 472 (e.g., normal to the plane of firing resistor 48) and toward a print medium upon energization of firing resistor 48.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Figure 5:
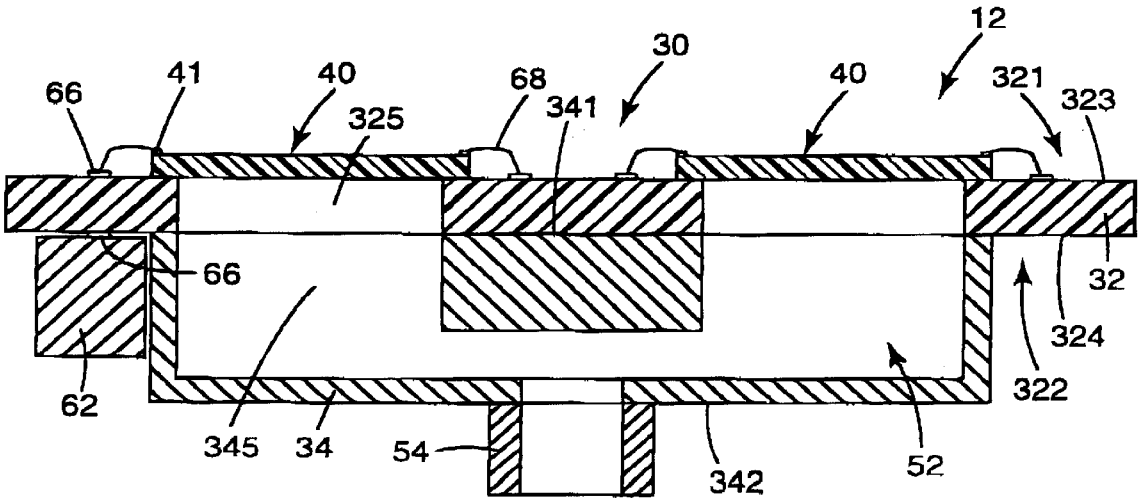
FIG. 5 is a schematic cross-sectional view illustrating one embodiment of an inkjet printhead assembly according to the present invention

Referring to FIGS. 2, 3, and 5, carrier 30 includes a substrate 32 and a substructure 34. Substrate 32 and substructure 34 both provide and/or accommodate mechanical, electrical, and fluidic functions of inkjet printhead assembly 12. More specifically, substrate 32 provides mechanical support for printhead dies 40, accommodates fluidic communication between ink supply assembly 14 and printhead dies 40 via ink delivery system 50, and provides electrical connection between and among printhead dies 40 and electronic controller 20 via electronic interface system 60. Substructure 34 provides mechanical support for substrate 32, accommodates fluidic communication between ink supply assembly 14 and printhead dies 40 via ink delivery system 50, and accommodates electrical connection between printhead dies 40 and electronic controller 20 via electronic interface system 60.

Substrate 32 has a first side 321 and a second side 322 which is opposite first side 321, and substructure 34 has a first side 341 and a second side 342 which is opposite first side 341. As such, first side 321 of substrate 32 defines a first surface 323 of substrate 32 and second side 322 of substrate 32 defines a second surface 324 of substrate 32. In one embodiment, printhead dies 40 are mounted on first side 321 of substrate 32 and substructure 34 is disposed on second side 322 of substrate 32. As such, first side 341 of substructure 34 contacts and, as described below, is joined to second side 322 of substrate 32.

For transferring ink between ink supply assembly 14 and printhead dies 40, substrate 32 and substructure 34 each have at least one ink passage 325 and 345, respectively, formed therein. Ink passage 325 extends through substrate 32 and provides a through-channel or through-opening for delivery of ink to printhead dies 40 and, more specifically, ink feed slot 441 of substrate 44 (FIG. 4). Ink passage 345 extends through substructure 34 and provides a through-channel or through-opening for delivery of ink to ink passage 325 of substrate 32. As such, ink passages 325 and 345 form a portion of ink delivery system 50. Although only one ink passage 325 is shown for a given printhead die 40, there may be additional ink passages to the same printhead die, for example, to provide ink of respective differing colors.

Figure 6:
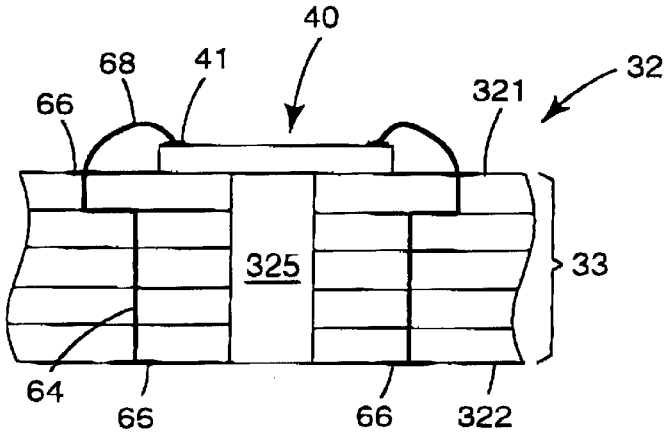
FIG. 6 is a schematic cross-sectional view illustrating one embodiment of a portion of a substrate according to the present invention.

For transferring electrical signals between electronic controller 20 and printhead dies 40, electronic interface system 60 includes a plurality of conductive paths 64 extending through substrate 32, as illustrated in FIG. 6. More specifically, substrate 32 includes conductive paths 64 which pass through and terminate at exposed surfaces of substrate 32. In one embodiment, conductive paths 64 include electrical contact pads 66 at terminal ends thereof which form, for example, I/O bond pads on substrate 32. Conductive paths 64, therefore, terminate at and provide electrical coupling between electrical contact pads 66.

Electrical contact pads 66 provide points for electrical connection to substrate 32 and, more specifically, conductive paths 64. Electrical connection is established, for example, via electrical connectors or contacts 62, such as I/O pins or spring fingers, wire bonds, electrical nodes, and/or other suitable electrical connectors. In one embodiment, printhead dies 40 include electrical contacts 41 which form I/O bond pads. As such, electronic interface system 60 includes electrical connectors, for example, wire bond leads 68, which electrically couple electrical contact pads 66 with electrical contacts 41 of printhead dies 40.

Conductive paths 64 transfer electrical signals between electronic controller 20 and printhead dies 40. More specifically, conductive paths 64 define transfer paths for power, ground, and data among and/or between printhead dies 40 and electrical controller 20. In one embodiment, data includes print data and non-print data. Print data includes, for example, nozzle data containing pixel information such as bitmap print data. Non-print data includes, for example, command/status (CS) data, clock data, and/or synchronization data. Status data of CS data includes, for example, printhead temperature or position, print resolution, and/or error notification.

In one embodiment, as illustrated in FIG. 6, substrate 32 includes a plurality of layers 33 each formed of a ceramic material. As such, substrate 32 includes circuit patterns which pierce layers 33 to form conductive paths 64. In one fabrication methodology, circuit patterns are formed in layers of unfired tape (referred to as green sheet layers) using a screen printing process. The green sheet layers are made of ceramic particles in a polymer binder. Alumina may be used for the particles, although other oxides or various glass/ceramic blends may be used. Each green sheet layer receives conductor lines and other metallization patterns as needed to form conductive paths 64. Such lines and patterns are formed with a refractory metal, such as tungsten, by screen printing on the corresponding green sheet layer. Thus, conductive and non-conductive or insulative layers are formed in substrate 32. While substrate 32 is illustrated as including layers 33, it is, however, within the scope of the present invention for substrate 32 to be formed of a solid pressed ceramic material. As such, conductive paths are formed, for example, as thin-film metallized layers on the pressed ceramic material.

While conductive paths 64 are illustrated as terminating at first side 321 and second side 322 of substrate 32, it is, however, within the scope of the present invention for conductive paths 64 to terminate at other sides of substrate 32. In addition, one or more conductive paths 64 may branch from and/or lead to one or more other conductive paths 64. Furthermore, one or more conductive paths 64 may begin and/or end within substrate 32. Conductive paths 64 may be formed as described, for example, in U.S. patent application Ser. No. 09/648,565, entitled "Wide-Array lnkjet Printhead Assembly with Internal Electrical Routing System" assigned to the assignee of the present invention and incorporated herein by reference.

In one embodiment, substructure 34 is formed of a non-ceramic material such as plastic. Substructure 34 is formed, for example, of a high performance plastic such as fiber reinforced Noryl® or polyphenylene sulfide (PPS). It is, however, within the scope of the present invention for substructure 34 to be formed of silicon, stainless steel, or other suitable material or combination of materials. Preferably, substructure 34 is chemically compatible with liquid ink so as to accommodate fluidic routing.

It is to be understood that FIGS. 5 and 6 are simplified schematic illustrations of carrier 30, including substrate 32 and substructure 34. The illustrative routing of ink passages 325 and 345 through substrate 32 and substructure 34, respectively, and conductive paths 64 through substrate 32, for example, has been simplified for clarity of the invention. Although various features of carrier 30, such as ink passages 325 and 345 and conductive paths 64, are schematically illustrated as being straight, it is understood that design constraints could make the actual geometry more complicated for a commercial embodiment of inkjet printhead assembly 12. Ink passages 325 and 345, for example, may have more complicated geometries to allow multiple colorants of ink to be channeled through carrier 30. In addition, conductive paths 64 may have more complicated routing geometries through substrate 32 to avoid contact with ink passages 325 and to allow for electrical connector geometries other than the illustrated I/O pins. It is understood that such alternatives are within the scope of the present invention.

As illustrated in FIG. 7, substrate 32 includes a bond region 70. Bond region 70, as defined inside the dashed lines, is provided on second side 322 of substrate 32 and represents where substructure 34 is joined to substrate 32. In one embodiment, bond region 70 includes a continuous path 72 defined on second surface 324 of substrate 32. Continuous path 72 coincides with a perimeter 346 of substructure 34 and, as such, defines where perimeter 346 of substructure 34 is joined to substrate 32. In addition, bond region 70 includes a plurality of paths 74 each defined on second surface 324 of substrate 32. Each path 74 surrounds a perimeter of one ink passage 325 of substrate 32 and also defines where substructure 34 is joined to substrate 32.

Referring to FIGS. 7 and 8, substrate 32 includes a surface deformation 80. In one embodiment, surface deformation 80 is provided on second side 322 of substrate 32. More specifically, surface deformation 80 is formed in second surface 324 of substrate 32. Surface deformation 80 represents a mechanical modification of second surface 324 and forms a non-uniform surface of substrate 32. As such, surface deformation 80 facilitates a mechanical bond to substrate 32, as described below.

In one embodiment, surface deformation 80 includes a plurality of voids 82 formed in second surface 324 of substrate 32. Voids 82 are uniformly spaced on second surface 324 and are of uniform shape. Voids 82, for example, are cylindrical in shape. While voids 82 are illustrated as being cylindrical in shape, it is within the scope of the present invention for voids 82 to be other shapes.

As illustrated in FIG. 7, surface deformation 80 and, more specifically, voids 82 are provided in bond region 70 of substrate 32. As such, voids 82 are provided within continuous path 72 and within paths 74. Thus, surface deformation 80 and, more specifically, voids 82 are provided in areas where substructure 34 is joined to substrate 32.

When substrate 32 is formed of layers 33, voids 82 are formed in an outer layer 331. As such, voids 82 form a plurality of holes through outer layer 331. In one embodiment, voids 82 are formed as unfilled vias through outer layer 331, for example, during processing of layers 33 as unfired, green sheet layers. It is, however, within the scope of the present invention for voids 82 to be formed in outer layer 331 after layers 33 have been fired. In addition, it is within the scope of the present invention for substrate 32 to be formed of a solid material, such as a pressed ceramic. As such, voids 82 are formed in a surface of the solid material.

As illustrated in FIG. 8, substructure 34 is joined to substrate 32 by an adhesive 90. As such, adhesive 90 is disposed in bond region 70 of substrate 32. Thus, when substructure 34 is joined to second side 322 of substrate 32, adhesive 90 conforms to surface deformation 80. More specifically, adhesive 90 penetrates a number of voids 82 provided in bond region 70. As such, adhesive 90 forms an interlocking joint 92 between substrate 32 and substructure 34 in bond region 70. Thus, in addition to forming a chemical bond between substrate 32 and substructure 34, adhesive 90 forms a mechanical bond between substrate 32 and substructure 34 by conforming to surface deformation 80. An example of adhesive 90 includes an epoxy-based adhesive compatible with inks.

Figure 9:
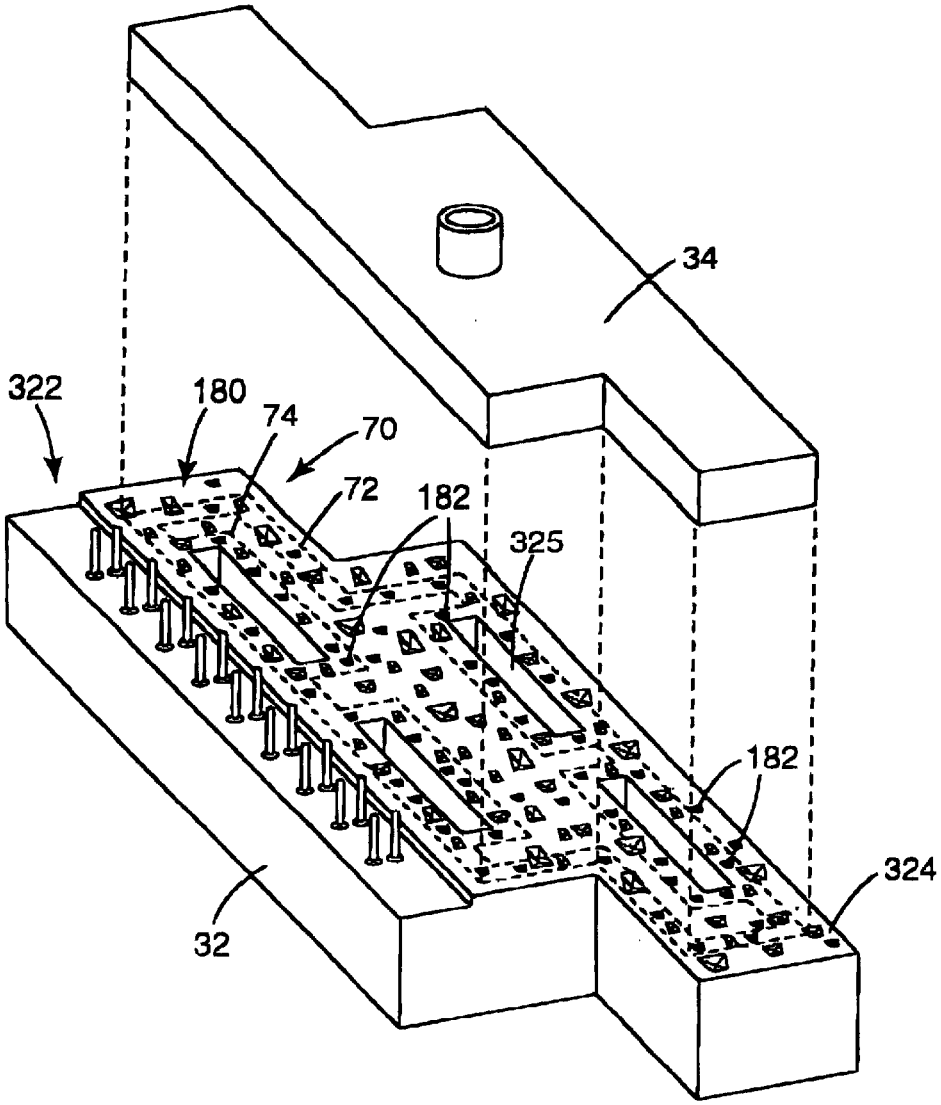
FIG. 9 is an exploded bottom perspective view similar to FIG. 7 illustrating another embodiment of a surface deformation of a substrate and joining of a substructure to the substrate according to the present invention.
Figure 10:
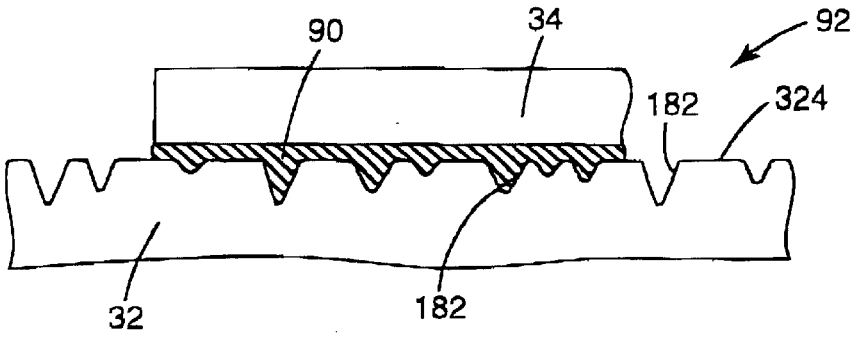
FIG. 10 is a schematic cross-sectional view illustrating one embodiment of joining the substructure to the substrate of FIG. 9 according to the present invention.

FIGS. 9 and 10 illustrate another embodiment of surface deformation 80. Surface deformation 180, similar to surface deformation 80, is provided on second side 322 of substrate 32 and, more specifically, formed in second surface 324 of substrate 32. As such, surface deformation 180 represents a mechanical modification of second surface 324 and forms a non-uniform surface of substrate 32. Thus, similar to surface deformation 80, surface deformation 180 facilitates a mechanical bond to substrate 32.

Similar to surface deformation 80, surface deformation 180 includes a plurality of voids 182 formed in second surface 324 of substrate 32. Voids 182 are randomly spaced on second surface 324 and are of varying shape including, varying sizes. Voids 182, however, are spaced such that multiple voids 182 are provided in bond region 70 of substrate 32, as illustrated in FIG. 9. As such, voids 182 are provided within continuous path 72 and within paths 74. Thus, surface deformation 180 and, more specifically, voids 182 are provided in areas where substructure 34 is joined to substrate 32. Voids 182 are formed, for example, by contacting second surface 324 of substrate 32, including rolling and/or pressing second surface 324. As such, when substrate 32 is formed of layers 33, voids 182 are formed during processing of layers 33 as unfired, green sheet layers. In addition, voids 182 may be formed by chemical etching areas of second surface 324. As such, voids 182 are formed after layers 33 have been fired.

As illustrated in FIG. 10, when substructure 34 is joined to second side 322 of substrate 32, adhesive 90 conforms to surface deformation 180. More specifically, similar to voids 82, adhesive 90 penetrates a number of voids 182 provided in bond region 70. As such, adhesive 90 forms an interlocking joint 92 between substrate 32 and substructure 34 in bond region 70. Thus, in addition to forming a chemical bond between substrate 32 and substructure 34, adhesive 90 forms a mechanical bond between substrate 32 and substructure 34 by conforming to surface deformation 180.

FIGS. 11 and 12 illustrate another embodiment of surface deformation 80. Surface deformation 280 is provided on second side 322 of substrate 32. More specifically, surface deformation 280 is formed on second surface 324 of substrate 32. Surface deformation 280 represents a mechanical modification of second surface 324 and forms a non-uniform surface of substrate 32. As such, surface deformation 280 facilitates a mechanical bond to substrate 32, as described below.

In-one embodiment, surface deformation 280 includes a plurality of particles 282 impregnated or infixed in and protruding from second surface 324 of substrate 32. Preferably, particles 282 are randomly spaced on second surface 324 and are of varying shape including, varying size. It is, however, within the scope of the present invention for particles 282 to be uniformly spaced on second surface 324 and/or of uniform shape including, uniform size.

As illustrated in FIG. 11, surface deformation 280 and, more specifically, particles 282 are provided in bond region 70 of substrate 32. As such, particles 282 are provided within continuous path 72 and within paths 74. Thus, surface deformation 280 and, more specifically, particles 282 are provided in areas where substructure 34 is joined to substructure 32.

Particles 282 may be formed, for example, of a ceramic material such as silicon carbide or larger grained Alumina. When substrate 32 is formed of layers 33, particles 282 are impregnated or infixed in outer layer 331. Particles 282 may be impregnated or infixed in outer layer 331, for example, during processing of layers 33 as unfired, green sheet layers.

As illustrated in FIG. 12, when substructure 34 is joined to second side 322 of substrate 32, adhesive 90 conforms to surface deformation 280. More specifically, adhesive 90 accommodates a number of particles 282 provided in bond region 70. As such, adhesive 90 forms an interlocking joint 92' between substrate 32 and substructure 34 in bond region 70. Thus, in addition to forming a chemical bond between substrate 32 and substructure 34, adhesive 90 forms a mechanical bond between substrate 32 and substructure 34 by conforming to surface deformation 280.

Substrate 32 and substructure 34 each have a coefficient of thermal expansion. In one embodiment, as described above, substrate 32 is formed of a ceramic material and substructure 34 is formed of a non-ceramic material such as plastic. As such, the coefficient of thermal expansion of substructure 34 is greater than the coefficient of thermal expansion of substrate 32. As components of inkjet printhead assembly 12, including substrate 32 and substructure 34, are subject to a predetermined temperature during operation of inkjet printhead assembly 12, an extent of expansion and/or contraction of substructure 34 is greater than that of substrate 32 during operation of inkjet printhead assembly 12. As such, shear stress is formed at a joint between substrate 32 and substructure 34. However, by forming substrate 32 with surface deformation 80, 180, or 280 and joining substrate 32 and substructure 34 with adhesive 90, interlocking joint 92 or 92' accommodates a difference of thermal expansion of substrate 32 and substructure 34.

Figure 13:
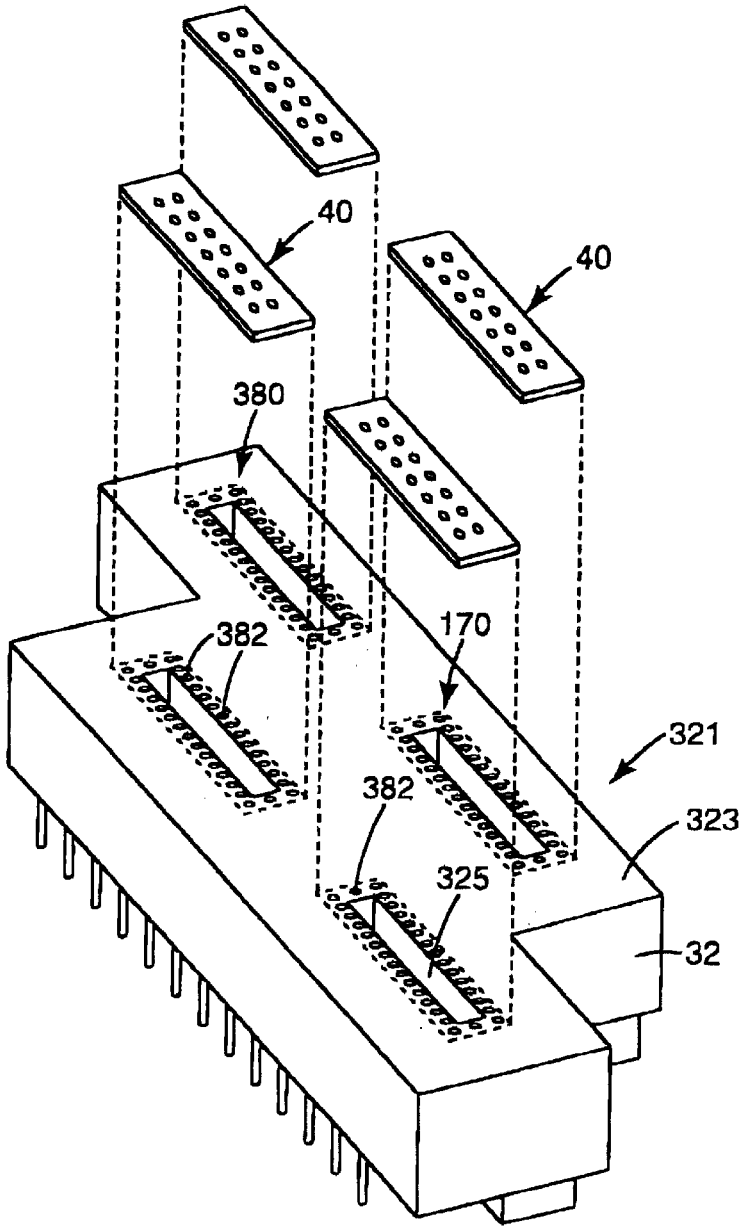
FIG. 13 is an exploded top perspective view of the inkjet printhead assembly of FIG. 2 illustrating one embodiment of a surface deformation of a substrate and mounting of a plurality of printhead dies on the substrate according to the present invention.

In one embodiment, as illustrated in FIG. 13, substrate 32 includes a plurality of bond regions 170. Bond regions 170, as defined by dashed lines, are provided on first side 321 of substrate 32 and represent where printhead dies 40 are mounted on substrate 32. As such, bond regions 170 are defined on first surface 323 of substrate 32 and each surround a perimeter of one ink passage 325 of substrate 32.

Figure 14:
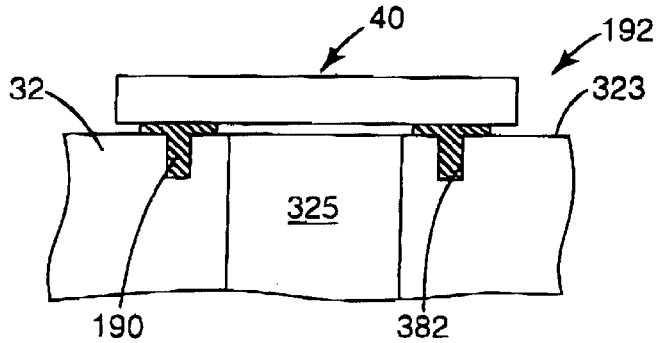
FIG. 14 is a schematic cross-sectional view illustrating one embodiment of mounting one of the printhead dies on the substrate in FIG. 13 according to the present invention.

FIGS. 13 and 14 illustrate another embodiment of surface deformation 80. Surface deformation 380 is similar to surface deformation 80 with the exception that surface deformation 380 is provided on first side 321 of substrate 32. More specifically, surface deformation 380 is formed in first surface 323 of substrate 32. Surface deformation 380 represents a mechanical modification of first surface 323 and forms a non-uniform surface of substrate 32. As such, surface deformation 380 facilitates a mechanical bond to substrate 32, as described below.

In one embodiment, surface deformation 380 includes a plurality of voids 382 formed in first surface 323 of substrate 32. Similar to voids 82, voids 382 are uniformly spaced on first surface 323 and are of uniform shape. In addition, voids 382 are provided within bond regions 170 of substrate 32. As such, surface deformation 380 and, more specifically, voids 382 are provided in areas where printhead dies 40 are mounted on substrate 32.

As illustrated in FIG. 14, printhead dies 40 are mounted on substrate 32 by an adhesive 190. As such, adhesive 190 is disposed in bond regions 170 of substrate 32. Thus, when printhead dies 40 are mounted on first side 321 of substrate 32, adhesive 190 conforms to surface deformation 380. More specifically, adhesive 190 penetrates a number of voids 382 provided in bond region 170. As such, adhesive 190 forms an interlocking joint 192 between substrate 32 and printhead dies 40. Thus, in addition to forming a chemical bond between substrate 32 and printhead dies 40, adhesive 190 forms a mechanical bond between substrate 32 and printhead dies 40 by conforming to surface deformation 380. An example of adhesive 190 includes an epoxy-based adhesive compatible with inks.

By forming substrate 32 with surface deformation 80, 180, or 280 and/or surface deformation 380, secure joints between components of inkjet printhead assembly 12 are formed. More specifically, by forming substrate 32 with surface deformation 80, 180, or 280 and joining substrate 32 and substructure 34 with adhesive 90, a secure joint between substrate 32 and substructure 34 is formed. In addition, by forming substrate 32 with surface deformation 380 and mounting printhead dies 40 on substrate 32 with adhesive 190, secure joints between printhead dies 40 and substrate 32 are formed. Thus, joints which can withstand temperature variations during operation of inkjet printhead assembly 12, joints which can withstand stresses such as normal and/or peeling stresses, and/or joints which are fluid tight may be formed between components of inkjet printhead assembly 12.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electro-mechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A printhead assembly, comprising:

a carrier including a substrate and a substructure joined to a first surface of the substrate; and a plurality of printhead dies each mounted on a second surface of the substrate, wherein the first surface of the substrate includes a surface deformation and the substructure is joined to the first surface by an adhesive, wherein the adhesive conforms to the surface deformation.

2. The printhead assembly of claim 1, wherein the first surface of the substrate includes a bond region, wherein the surface deformation is provided within the bond region, and wherein the substructure is joined to the substrate in the bond region.

3. The printhead assembly of claim 2, wherein the bond region includes a continuous path defined on the first surface of the substrate, wherein the surface deformation is provided within the continuous path.

4. The printhead assembly of claim 2, wherein the substrate has a plurality of fluid passages extending therethrough, wherein the bond region includes a plurality of paths each defined on the first surface of the substrate and surrounding a perimeter of one of the fluid passages, wherein the surface deformation is provided within each of the plurality of paths.

5. The printhead assembly of claim 1, wherein the surface deformation includes a plurality of voids formed in the first surface of the substrate, wherein the adhesive penetrates a number of the voids.

6. The printhead assembly of claim 5, wherein the voids are one of uniformly spaced and randomly spaced on the first surface of the substrate.

7. The printhead assembly of claim 5, wherein each of the voids are one of uniformly shaped and of varying shape.

8. The printhead assembly of claim 1, wherein the surface deformation includes a plurality of particles infixed in and protruding from the first surface of the substrate, wherein the adhesive accommodates a number of the particles.

9. The printhead assembly of claim 8, wherein the particles are formed of a ceramic material.

10. The printhead assembly of claim 1, wherein the substrate includes a ceramic material and the substructure includes at least one of plastic and metal.

11. The printhead assembly of claim 10, wherein the substrate includes a plurality of layers of the ceramic material, wherein the surface deformation is formed in one of the layers of the ceramic material.

12. The printhead assembly of claim 1, wherein the second surface of the substrate includes a second surface deformation and the printhead dies are mounted on the second surface by a second adhesive, wherein the second adhesive conforms to the second surface deformation.

13. The printhead assembly of claim 12, wherein the substrate has a plurality of fluid passages extending therethrough, wherein the second surface deformation includes a plurality of voids formed in the second surface of the substrate and spaced around a perimeter of each of the fluid passages, wherein the second adhesive penetrates a number of the voids.

14. A method of forming a printhead assembly, the method comprising:

providing a substrate having a first side and a second side;

including a surface deformation on the first side of the substrate;

joining a substructure to the first side of the substrate with an adhesive, including conforming the adhesive to the surface deformation; and mounting a plurality of printhead dies on the second side of the substrate.

15. The method of claim 14, further comprising:

defining a bond region of the first side of the substrate, wherein including the surface deformation on the first side of the substrate includes providing the surface deformation within the bond region, and wherein joining the substructure to the first side of the substrate includes joining the substructure to the substrate in the bond region.

16. The method of claim 15, wherein defining the bond region of the first side of the substrate includes defining a continuous path on the first side of the substrate, wherein including the surface deformation on the first side of the substrate includes providing the surface deformation within the continuous path.

17. The method of claim 15, wherein the substrate has a plurality of fluid passages extending therethrough, wherein defining the bond region of the first side of the substrate includes defining a plurality of paths each surrounding a perimeter of one of the fluid passages, wherein including the surface deformation on the first side of the substrate includes providing the surface deformation within each of the plurality of paths.

18. The method of claim 14, wherein including the surface deformation on the first side of the substrate includes forming a plurality of voids in the first side of the substrate, wherein conforming the adhesive to the surface deformation includes penetrating a number of the voids with the adhesive.

19. The method of claim 18, wherein forming the plurality of voids in the first side of the substrate includes one of uniformly spacing and randomly spacing the plurality of voids on the first side of the substrate.

20. The method of claim 18, wherein forming the plurality of voids in the first side of the substrate includes forming each of the voids with one of a uniform shape and a varying shape.

21. The method of claim 14, wherein including the surface deformation on the first side of the substrate includes infixing a plurality of particles in and protruding the particles from the first side of the substrate.

22. The method of claim 21, wherein the particles are formed of a ceramic material.

23. The method of claim 14, wherein the substrate includes a ceramic material and the substructure includes at least one of plastic and metal.

24. The method of claim 23, wherein the substrate includes a plurality of layers of the ceramic material, wherein including the surface deformation on the first side of the substrate includes forming the surface deformation in one of the layers of the ceramic material.

25. The method of claim 14, further comprising:

including a second surface deformation on the second side of the substrate, wherein mounting the printhead dies on the second side of the substrate includes mounting the printhead dies on the second side of the substrate with a second adhesive, including conforming the second adhesive to the second surface deformation.

26. The method of claim 25, wherein the substrate has a plurality of fluid passages extending therethrough, wherein including the second surface deformation on the second side of the substrate includes forming a plurality of voids in the second side of the substrate and spacing the voids around a perimeter of each of the fluid passages, wherein conforming the second adhesive to the second surface deformation includes penetrating a number of the voids with the second adhesive.

27. A carrier adapted to receive a plurality of printhead dies, the carrier comprising:

a substrate including a first material and having a first side adapted to receive the printhead dies and a second side opposite the first side, wherein the second side of the substrate includes a surface deformation; and a substructure formed of a second material and joined to the second side of the substrate by an adhesive, wherein the adhesive conforms to the surface deformation of the substrate.

28. The carrier of claim 27, wherein the second side of the substrate includes a bond region, wherein the surface deformation is provided in the bond region, and wherein the substructure is joined to the substrate in the bond region.

29. The carrier of claim 28, wherein the bond region includes a continuous path defined on the second side of the substrate, wherein the surface deformation is provided within the continuous path.

30. The carrier of claim 28, wherein the substrate has a plurality of fluid passages extending therethrough, wherein the bond region includes a plurality of paths each defined on the second side of the substrate and surrounding a perimeter of one of the fluid passages, wherein the surface deformation is provided within each of the plurality of paths.

31. The carrier of claim 27, wherein the surface deformation includes a plurality of voids formed in the second side of the substrate, wherein the adhesive penetrates a number of the voids.

32. The carrier of claim 31, wherein the voids are one of uniformly spaced and randomly spaced on the second side of the substrate.

33. The carrier of claim 31, wherein each of the voids are one of uniformly shaped and of varying shape.

34. The carrier of claim 27, wherein the surface deformation includes a plurality of particles infixed in and protruding from the second side of the substrate.

35. The carrier of claim 34, wherein the particles are formed of a ceramic material.

36. The carrier of claim 27, wherein the first material includes a ceramic material and the second material includes at least one of plastic and metal.

37. The carrier of claim 36, wherein the first material includes a plurality of layers of the ceramic material, wherein the surface deformation is formed in one of the layers of the ceramic material.

38. The carrier of claim 27, wherein the substrate has a plurality of fluid passages extending therethrough, wherein the first side of the substrate has a plurality of voids formed therein and spaced around a perimeter of each of the fluid passages.

* * * * *